US006918551B2

(12) United States Patent
Baltz

(10) Patent No.: US 6,918,551 B2
(45) Date of Patent: Jul. 19, 2005

(54) DUAL PURGE MANIFOLD

(75) Inventor: James P. Baltz, Waterville, OH (US)

(73) Assignee: Illinois Tool Works Inc., Glenview, IL (US)

( * ) Notice: Subject to any disclaimer, the term of this patent is extended or adjusted under 35 U.S.C. 154(b) by 102 days.

(21) Appl. No.: 10/621,733

(22) Filed: Jul. 17, 2003

(65) Prior Publication Data

US 2005/0011975 A1 Jan. 20, 2005

(51) Int. Cl.[7] ..... B05B 5/04
(52) U.S. Cl. ..... 239/691; 118/629
(58) Field of Search ..... 239/112, 113, 239/690, 690.1, 691, 695, 699, 700, 703, 706, 708; 118/629; 427/27

(56) References Cited

U.S. PATENT DOCUMENTS

| | | | |
|---|---|---|---|
| 1,655,262 | A | 1/1928 | Fortin |
| 2,547,440 | A | 4/1951 | Clark et al. |
| 2,673,232 | A | 3/1954 | Silsby, Jr. |
| 2,814,551 | A | 11/1957 | Broeze et al. |
| 3,098,890 | A | 7/1963 | Peterson |
| 3,122,320 | A | 2/1964 | Beck et al. |
| 3,155,539 | A | 11/1964 | Juvinall |
| 3,169,882 | A | 2/1965 | Juvinall et al. |
| 3,169,883 | A | 2/1965 | Juvinall |
| 3,291,889 | A | 12/1966 | Uline et al. |
| 3,674,205 | A | 7/1972 | Kock |
| 3,838,946 | A | 10/1974 | Schall |
| 3,893,620 | A | 7/1975 | Rokadia |
| 3,933,285 | A | 1/1976 | Wiggins |
| 3,934,055 | A | 1/1976 | Tamny |
| 4,017,029 | A | 4/1977 | Walberg |
| 4,020,866 | A | 5/1977 | Wiggins |
| 4,030,860 | A | 6/1977 | Standlick |
| 4,085,892 | A | 4/1978 | Dalton |
| 4,148,932 | A | 4/1979 | Tada et al. |
| 4,232,055 | A | 11/1980 | Shaffer |
| 4,275,834 | A | 6/1981 | Spanjersberg et al. |
| 4,275,838 | A | 6/1981 | Fangmeyer |
| 4,311,724 | A | 1/1982 | Scharfenberger |
| 4,313,475 | A | 2/1982 | Wiggins |
| 4,348,425 | A | 9/1982 | Scharfenberger |
| 4,350,720 | A | 9/1982 | Scharfenberger |
| 4,381,079 | A | 4/1983 | Allen |
| 4,381,180 | A | 4/1983 | Sell |
| 4,383,644 | A | 5/1983 | Spanjersberg et al. |

(Continued)

FOREIGN PATENT DOCUMENTS

| | | |
|---|---|---|
| GB | 1393333 | 5/1975 |
| GB | 1478853 | 7/1977 |

OTHER PUBLICATIONS

"Aerobell 33™ Rotary Atomizer", ITW Ransburg Electrostatic Systems, Service Manual, 2001.

*Primary Examiner*—Gene Mancene
*Assistant Examiner*—Thach H. Bui
(74) *Attorney, Agent, or Firm*—Lisa M. Soltis; Mark W. Croll; Richard D. Conard

(57) ABSTRACT

A coating material dispensing system including a coating dispenser having a terminal for coupling to a high-magnitude potential supply, supply valves having respective input ports, respective output ports, and respective control ports, first purge valves having respective input ports, respective output ports, and respective control ports, a second purge valve having an input port, an output port and a control port, and means for coupling: the output port of a first one of the supply valves to a common point in a fluid circuit; the output port of a second one of the supply valves to the common point; the output port of the second purge valve to the common point; and, the common point to the coating dispenser, the common point also coupled to ground.

8 Claims, 1 Drawing Sheet

U.S. PATENT DOCUMENTS 4,386,888 A 6/1983 Verley
4,403,736 A 9/1983 Scharfenberger
4,413,788 A 11/1983 Schaefer et al.
4,422,576 A 12/1983 Saito et al.
4,447,008 A 5/1984 Allen
4,487,367 A 12/1984 Perry et al.
4,508,266 A 4/1985 Saito et al.
4,515,516 A 5/1985 Perrine et al.
4,592,305 A 6/1986 Scharfenberger
4,728,034 A 3/1988 Matsumura et al.
4,741,673 A 5/1988 Jubb
4,792,092 A 12/1988 Elberson et al.
4,846,226 A 7/1989 Merritt
4,878,622 A 11/1989 Jamison et al.
4,879,137 A 11/1989 Behr et al.
4,881,688 A 11/1989 Hankvist et al.
4,884,745 A 12/1989 Spongh
4,932,589 A 6/1990 Diana
4,962,724 A 10/1990 Prus et al.
4,982,903 A 1/1991 Jamison et al.
5,033,942 A 7/1991 Petersen
5,058,812 A 10/1991 Cox et al.
5,078,168 A 1/1992 Konieczynski
5,096,126 A 3/1992 Giroux et al.
5,102,046 A 4/1992 Diana
5,146,950 A 9/1992 Rodgers et al.
5,154,357 A 10/1992 Jamison et al.
5,193,750 A 3/1993 LaMontagne et al.
5,197,676 A 3/1993 Konieczynski et al.
5,249,748 A 10/1993 Lacchia et al.
5,255,856 A 10/1993 Ishibashi et al.
5,632,816 A 5/1997 Allen et al.
5,725,150 A 3/1998 Allen et al.
5,746,831 A 5/1998 Allen et al.
5,787,928 A 8/1998 Allen et al.
5,944,045 A 8/1999 Allen et al.
6,010,084 A 1/2000 Yoshida et al.
6,196,478 B1 3/2001 McPherson, Jr.
6,423,143 B1 7/2002 Allen et al.

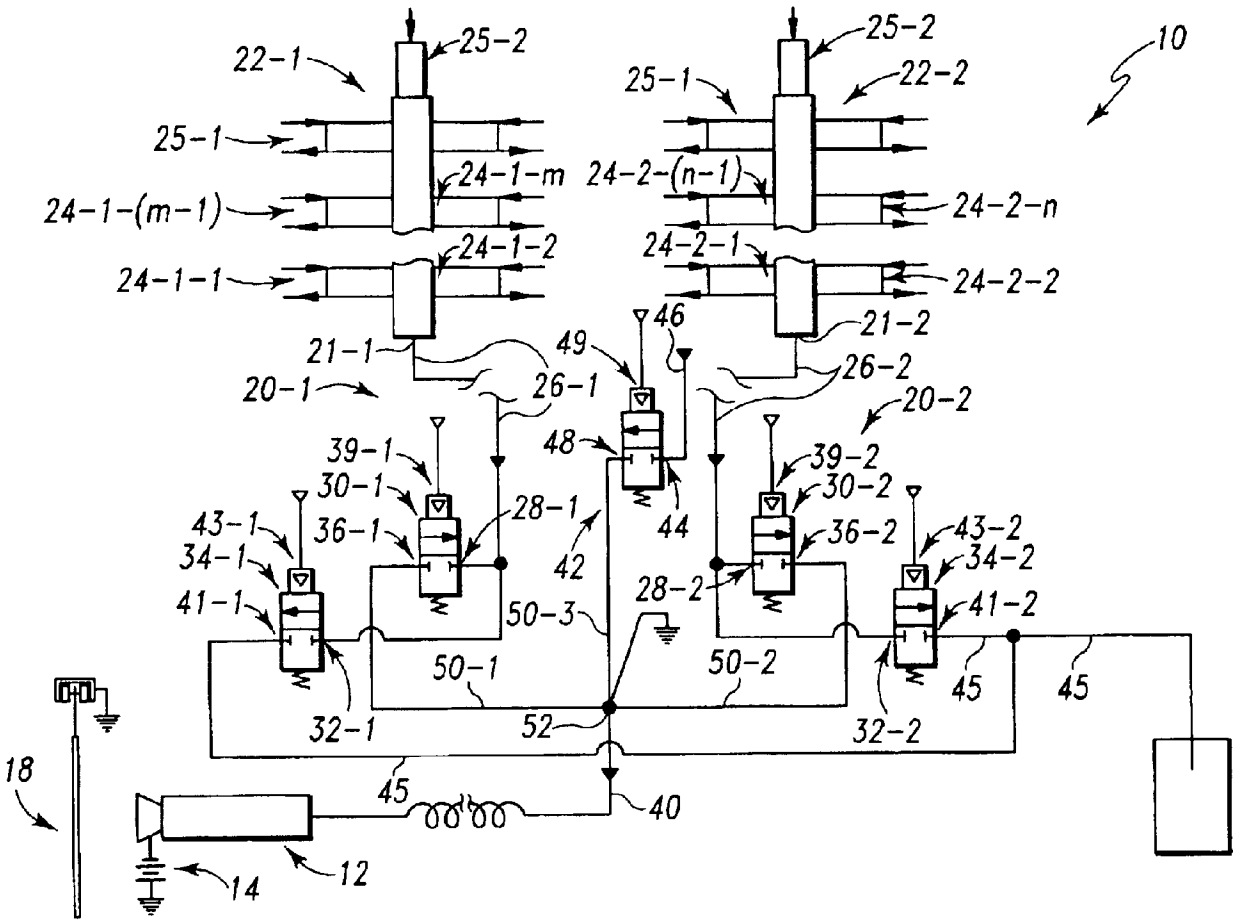
10
25-2
22-2
24-2-n
24-2-2
21-2
26-2
20-2
39-2
30-2
36-2
43-2
34-2
41-2
32-2
45
25-1
24-2-(n-1)
24-2-1
46
44
49
48
28-2
50-2
40
42
50-3
52
26-1
28-1
25-2
24-1-m
24-1-2
21-1
20-1
39-1
30-1
36-1
50-1
32-1
45
22-1
25-1
24-1-(m-1)
24-1-1
43-1
34-1
41-1
12
14
18

DUAL PURGE MANIFOLD

FIELD OF THE INVENTION

This invention relates to electrostatically-aided coating methods and apparatus.

BACKGROUND OF THE INVENTION

Various methods and apparatus for coupling a coating material dispensing device which is maintained at high-magnitude electrostatic potential to a manifold through which various types, for example, colors, of coating material and other services, such as solvent(s), and purging and drying gases, such as compressed air, are known. There are, for example, the devices illustrated and described in U.S. Pat. Nos.: 3,674,205; 4,422,576; 4,487,367; 4,508,266; 4,728,034; 5,725,150; 5,787,928; 6,010,084; 6,196,478; and, 6,423,143.

Additionally, many voltage blocks are illustrated and described in the prior art. There are, for example, the voltage blocks illustrated and described in U.S. Pat. Nos. 6,423,143; 5,944,045; 5,787,928; 5,746,831; 5,725,150; 5,632,816; 4,878,622; 4,982,903; 5,033,942; 5,154,357; and 5,193,750, and the references cited in those patents, particularly including U.S. Pat. Nos. 1,655,262; 2,547,440; 2,673,232; 3,098,890; 3,122,320; 3,291,889; 3,893,620; 3,933,285; 3,934,055; 4,017,029; 4,020,866; 4,085,892; 4,275,834; 4,313,475; 4,383,644; and, 4,413,788, and U.K. Patent Specifications 1,393,333 and 1,478,853. Also of interest are U.S. Pat. Nos. 2,814,551; 3,838,946; 4,030,860; 4,232,055; 4,381,180; 4,386,888; 4,515,516; 4,741,673; 4,792,092; 4,879,137; 4,881,688; 4,884,745; 4,932,589; 4,962,724; 5,078,168; 5,096,126; 5,102,045; 5,102,046; 5,197,676; 5,249,748; and, 5,255,856.

The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a coating material dispensing system includes a coating dispenser, a high-magnitude potential supply to provide charge to the dispenser, supply valves and a first purge valve. The supply valves have respective input ports, respective output ports, and respective control ports. The first purge valve has an input port, an output port and a control port. A conduit couples the output port of a first one of the supply valves to a common point in a fluid circuit. A conduit couples the output port of a second one of the supply valves to the common point. A conduit couples the output port of the first purge valve to the common point. A conduit couples the common point to the coating dispenser to provide fluid from one of: the output port of said first one of the supply valves; the output port of said second one of the supply valves; and the output port of the first purge valve, to the coating dispenser. The common point is coupled to ground.

Illustratively according to this aspect of the invention, the circuit includes two manifolds, each including a valve for each different type of coating material to be dispensed through that respective manifold. Each manifold includes an output port coupled to an input port of a respective one of the supply valves.

Further illustratively according to this aspect of the invention, the circuit includes second purge valves. The second purge valves have respective input ports, respective output ports, and respective control ports. The circuit further includes a container for receiving fluid purged from the circuit. The circuit also includes two manifolds, each including a valve for each different type of coating material to be dispensed through that respective manifold. Each manifold includes an output port coupled to an input port of a respective one of the second purge valves. An output port of each of the second purge valves is coupled to the container for receiving fluid purged from the circuit.

According to another aspect of the invention, a coating material dispensing system includes a coating dispenser having a terminal for coupling to a high-magnitude potential supply for providing electrical charge to the coating material as the coating material is dispensed by the dispenser. The system further includes supply valves and a purge valve. The supply valves have respective input ports, respective output ports, and respective control ports. The purge valve has an input port, an output port and a control port. Means are provided for coupling the output port of a first one of the supply valves to a common point in a fluid circuit; for coupling the output port of a second one of the supply valves to the common point; for coupling the output port of the purge valve to the common point; and, for coupling the common point to the coating dispenser. The common point is coupled to ground.

Illustratively according to this aspect of the invention, the means for coupling: the output port of a first one of the supply valves to a common point in the circuit; the output port of a second one of the supply valves to the common point; the output port of the second purge valve to the common point; and, for coupling the common point to the coating dispenser comprises: a conduit for coupling the output port of the first one of the supply valves to the common point in the circuit; a conduit for coupling the output port of the second one of the supply valves to the common point; a conduit for coupling the output port of the second purge valve to the common point; and, a conduit for coupling the common point to the coating dispenser.

Additionally illustratively according to this aspect of the invention, the circuit includes two manifolds. Each manifold includes a valve for each different type of coating material to be dispensed through that respective manifold. Each manifold includes an output port coupled to an input port of a respective one of the supply valves.

Illustratively according to this aspect of the invention, the circuit includes a container for receiving fluid purged from the circuit. The circuit includes two manifolds. Each of the two manifolds includes a valve for each different type of coating material to be dispensed through that respective manifold. Each manifold includes an output port coupled to an input port of a respective one of the first purge valves. An output port of each of the purge valves is coupled to the container for receiving fluid purged from the circuit.

According to another aspect of the invention, a method for dispensing coating material includes coupling a coating dispenser to a high-magnitude potential supply to provide charge to the dispenser, and providing supply valves and a purge valve, each having respective input ports, respective output ports, and respective control ports. The method further includes coupling: the output port of a first one of the supply valves to a common point in a fluid circuit; the output port of a second one of the supply valves to the common point; the output port of the purge valve to the common point; and, the common point to the coating dispenser. The method further includes coupling the common point to ground.

BRIEF DESCRIPTION OF THE DRAWINGS

The invention may best be understood by referring to the following detailed description and accompanying drawing which illustrates the invention. The drawing illustrates a schematic diagram of a system incorporating the invention.

DETAILED DESCRIPTIONS OF ILLUSTRATIVE EMBODIMENTS

The drawing illustrates a dual purge system 10 for an electrostatic coating dispenser 12 of any of the general types illustrated in, for example, U.S. Pat. Nos.: 3,155,539; 3,169,882; 3,169,883; 4,148,932; 4,275,838; 4,381,079; 4,447,008; and, DeVilbiss Ransburg AEROBELL® type 33 liquid rotary atomizer available from ITW Ransburg Electrostatic Systems, 320 Phillips Avenue, Toledo, Ohio 43612. The dispenser 12 is coupled to a high-magnitude voltage output terminal of a high-magnitude potential supply 14 to impart charge to particles of coating material dispensed by the dispenser 12 to facilitate the deposit of the thus-charged particles on an article 18 to be coated by the particles, all in accordance with known principles.

The coating material to be dispensed is supplied through two parallel circuits 20-1, 20-2 from one, two or more coating material supplies. Where more than two supplies are present, each circuit 20-1, 20-2 may be coupled to an output port 21-1, 21-2 of a respective manifold 22-1, 22-2 which is supplied with multiple coating material types, for example, multiple colors. The color to be dispensed at any given time is selected by actuating that color's respective valve 24-1-1, 24-1-2, . . . 24-1-($m$−1), 24-1-$m$, 24-2-1, 24-2-2, . . . 24-2-($n$−1), 24-2-$n$ on a respective one of the manifolds 22-1, 22-2. Other valves 25-1, 25-2 on each of manifolds 22-1 and 22-2 supply solvent and a drying agent, for example, compressed air, to the manifolds 22-1 and 22-2 to flush and dry the manifolds 22-1, 22-2 between dispensing one color and dispensing the next color.

Conduits 26-1, 26-2 couple the respective supplies 21-1, 21-2 to input ports 28-1, 28-2 of respective trigger valves 30-1 and 30-2 and to input ports 32-1 and 32-2 of respective dump valves 34-1 and 34-2. Output ports 36-1 and 36-2 of the respective trigger valves 30-1 and 30-2 are coupled through respective conduits 50-1, 50-2 to a common conduit 40 which is coupled to dispenser 12 to supply the selected coating material to it. The input ports 28-1, 28-2 of trigger valves 30-1, 30-2, respectively, are coupled to their respective output ports 36-1, 36-2 when a signal of, for example, compressed air is applied at their respective pilot input ports 39-1, 39-2. Input ports 32-1, 32-2 of dump valves 34-1, 34-2, respectively, are coupled to their respective output ports 41-1, 41-2 when a signal of, for example, compressed air is applied at their respective pilot input ports 43-1, 43-2. Output ports 41-1, 41-2 are coupled through a common dump conduit 45 to a refuse container.

A solvent trigger valve 42 includes an input port 44 which is coupled to an appropriate source 46 of solvent. An output port 48 of solvent trigger valve 42 is coupled to common conduit 40. The presence or absence of a signal of, for example, compressed air, applied to pilot input port 49 controls the state of valve 42, that is, whether its input port 44 is coupled to its output port 48 or whether its input and output ports 44, 48, respectively, are isolated from one another.

The lengths of conduit 50-1, 50-2 and 50-3 which couple output ports 36-1, 36-2 and 48 to conduit 40 are coupled together at an electrically non-insulative fitting 52 which is coupled to ground. This helps to maintain valves 30-1, 30-2, 42 at ground. Although not so illustrated, the manifolds 22-1, 22-2 and their valves 24-1-1, 24-1-2, . . . 24-1-($m$−1), 24-1-$m$, 24-2-1, 24-2-2, . . . 24-2-(n−1), 24-2-$n$, and valves 30-1, 30-2, 34-1, 34-2, 42 are also typically coupled to, and maintained at or near, ground potential. This aids in purging of one circuit 20-1 or 20-2 while coating material is being delivered through the other circuit 20-2 or 20-1, respectively, to be dispensed by dispenser 12. Conduit 40 illustratively is a coiled tube of sufficient length to stand off the high magnitude potential established by supply 14 on dispenser 12 sufficiently from the ground at fitting 52 to permit electrostatically-aided dispensing. The lengths of conduit 50-1, 50-2 and 50-3 are kept as short as feasible to minimize the fluid content of these lengths of conduit 50-1, 50-2 and 50-3.

This arrangement permits faster color change, since the only components that require cleaning to change colors are conduit 40 and the dispenser 12. All remaining components of a respective circuit 20-1 or 20-2 can be cleaned off line, that is, while coating material is being dispensed from the other circuit 20-2 or 20-1, respectively. Further, since the system includes an inline solvent valve 42, clean purge solvent is present at fitting 52, which permits color change to be executed faster, resulting in increased throughput in a coating operation.

What is claimed is:

1. A coating material dispensing system including a coating dispenser, a high-magnitude potential supply to provide charge to the dispenser, supply valves having respective input ports, respective output ports, and respective control ports, a first purge valve having an input port, an output port and a control port, a conduit coupling the output port of a first one of the supply valves to a common point in a fluid circuit, a conduit coupling the output port of a second one of the supply valves to the common point, a conduit coupling the output port of the first purge valve to the common point, and a conduit coupling the common point to the coating dispenser to provide fluid from one of: the output port of said first one of the supply valves; the output port of said second one of the supply valves; and the output port of the first purge valve, to the coating dispenser, the common point coupled to ground.

2. The apparatus of claim 1 wherein the circuit includes two manifolds, each including a valve for each different type of coating material to be dispensed through that respective manifold, each manifold including an output port coupled to an input port of a respective one of the supply valves.

3. The apparatus of claim 1 wherein the circuit includes second purge valves having respective input ports, respective output ports, and respective control ports, a container for receiving fluid purged from the circuit, the circuit including two manifolds, each including a valve for each different type of coating material to be dispensed through that respective manifold, each manifold including an output port coupled to an input port of a respective one of the second purge valves, an output port of each of the second purge valves being coupled to the container for receiving fluid purged from the circuit.

4. A coating material dispensing system including a coating dispenser having a terminal for coupling to a high-magnitude potential supply for providing electrical charge to the coating material as the coating material is dispensed by the dispenser, supply valves having respective input ports, respective output ports, and respective control ports, first purge valves having respective input ports, respective output ports, and respective control ports, a second purge valve having an input port, an output port and a control port, and means for coupling: the output port of a first one of the supply valves to a common point in a fluid circuit; the output port of a second one of the supply valves to the common point; the output port of the second purge valve to the common point; and, the common point to the coating dispenser, the common point also coupled to ground.

5. The apparatus of claim 4 wherein the means for coupling: the output port of a first one of the supply valves to a common point in the circuit; the output port of a second one of the supply valves to the common point; the output port of the second purge valve to the common point; and, for coupling the common point to the coating dispenser comprises: a conduit for coupling the output port of the first one of the supply valves to the common point in the circuit; a conduit for coupling the output port of the second one of the supply valves to the common point; a conduit for coupling the output port of the second purge valve to the common point; and, a conduit for coupling the common point to the coating dispenser.

6. The apparatus of claim 4 wherein the circuit includes two manifolds, each including a valve for each different type of coating material to be dispensed through that respective manifold, each manifold including an output port coupled to an input port of a respective one of the supply valves.

7. The apparatus of claim 4 wherein the circuit includes a container for receiving fluid purged from the circuit, the circuit including two manifolds, each including a valve for each different type of coating material to be dispensed through that respective manifold, each manifold including an output port coupled to an input port of a respective one of the first purge valves, an output port of each of the purge valves being coupled to the container for receiving fluid purged from the circuit.

8. A method for dispensing coating material, the method including providing a coating dispenser, coupling the coating dispenser to a high-magnitude potential supply to provide charge to the dispenser, providing supply valves having respective input ports, respective output ports, and respective control ports, providing first purge valves having respective input ports, respective output ports, and respective control ports, providing a second purge valve having an input port, an output port and a control port, and coupling: the output port of a first one of the supply valves to a common point in a fluid circuit; the output port of a second one of the supply valves to the common point; the output port of the second purge valve to the common point; and, the common point to the coating dispenser, and coupling the common point to ground.

* * * * *